US009365046B2

(12) United States Patent
Sugitani et al.

(10) Patent No.: US 9,365,046 B2
(45) Date of Patent: Jun. 14, 2016

(54) INK CIRCULATION TYPE INKJET PRINTER

(71) Applicant: RISO KAGAKU CORPORATION, Tokyo (JP)

(72) Inventors: Hiroshi Sugitani, Ibaraki (JP); Tomoyuki Akiyama, Ibaraki (JP); Akira Nishiyama, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/742,902

(22) Filed: Jun. 18, 2015

(65) Prior Publication Data

US 2015/0375518 A1 Dec. 31, 2015

(30) Foreign Application Priority Data

Jun. 25, 2014 (JP) ..... 2014-129981

(51) Int. Cl.
*B41J 2/175* (2006.01)

(52) U.S. Cl.
CPC ..... *B41J 2/17596* (2013.01)

(58) Field of Classification Search
CPC ..... B41J 2/18; B41J 2/17596; B41J 2/02; B41J 2002/022
USPC ..... 347/6, 7, 89
See application file for complete search history.

(56) References Cited

U.S. PATENT DOCUMENTS 8,366,224 B2 * 2/2013 Yokota ..... B41J 2/14233 347/7
8,540,352 B2 * 9/2013 Igarashi ..... B41J 2/17596 347/84
9,016,843 B2 4/2015 Nishiyama et al.
9,061,516 B2 6/2015 Akiyama et al.
2005/0052513 A1 * 3/2005 Inoue ..... B41J 2/175 347/89
2009/0284563 A1 * 11/2009 Bansyo ..... B41J 2/16532 347/19
2012/0188314 A1 * 7/2012 Akiyama ..... B41J 2/175 347/85

FOREIGN PATENT DOCUMENTS

JP 2009297961 A * 12/2009
JP 2011-167873 A 9/2011
JP 5376998 B2 * 12/2013

OTHER PUBLICATIONS

U.S. Appl. No. 14/743,164 to Hiroyuki Nakamura, which was filed on Jun. 18, 2015.
U.S. Appl. No. 14/851,163 to Hiroshi Sugitani et al., which was filed on Sep. 11, 2015.
U.S. Appl. No. 14/849,883 to Hiroshi Sugitani et al., which was filed on Sep. 10, 2015.
U.S. Appl. No. 14/826,460 to Tomoyuki Akiyama et al., which was filed on Aug. 14, 2015.
U.S. Appl. No. 14/801,069 to Akira Nishiyama et al., which was filed on Jul. 16, 2015.

* cited by examiner

*Primary Examiner* — Stephen Meier
*Assistant Examiner* — Sharon A Polk
(74) *Attorney, Agent, or Firm* — Greenblum & Bernstein, P.L.C.

(57) ABSTRACT

Upon supply of inks to second tanks of a plurality of printing units with the second tanks in communication with each other via a negative-pressure common air chamber in an air-tight state and with a negative-pressure force applied to the second tanks and the negative-pressure common air chamber, a controller is configured to drive ink supply units of the plurality of printing units to supply the inks such that times in which the inks flow into the second tanks in the plurality of printing units do not coincide with each other.

8 Claims, 8 Drawing Sheets

| STATE OF POSITIVE-PRESSURE TANK LIQUID LEVEL SENSOR | STATE OF NEGATIVE-PRESSURE TANK LIQUID LEVEL SENSOR | FEEDING TO POSITIVE-PRESSURE TANK | INK SUPPLY |
|---|---|---|---|
| ON | ON | NOT PERFORMED | NOT PERFORMED |
| OFF | ON | PERFORMED | NOT PERFORMED |
| ON | OFF | NOT PERFORMED | NOT PERFORMED |
| OFF | OFF | NOT PERFORMED | PERFORMED |

INK CIRCULATION TYPE INKJET PRINTER

CROSS REFERENCE TO RELATED APPLICATION

This application is based upon and claims the benefit of priority from the prior Japanese Patent Application No. 2014-129981, filed on Jun. 25, 2014, the entire contents of which are incorporated herein by reference.

BACKGROUND

1. Technical Field

The disclosure relates to an ink circulation type inkjet printer.

2. Related Art

There is known an ink circulation type inkjet printer which performs printing by ejecting inks from inkjet heads while circulating the inks. The ink circulation type inkjet printer has the following advantages: misfiring of the inks caused by foreign objects in the inks is reduced; and temperature rise in the inkjet heads is suppressed by a cooling effect of the inks achieved by the ink circulation, for example.

The ink circulation type inkjet printer includes an inkjet head and ink tanks disposed upstream and downstream of the inkjet head. These head and tanks are connected to each other by ink conduits. The ink is supplied to the inkjet head from a positive-pressure tank which is the upstream ink tank, and is ejected from the inkjet head. The ink not consumed in the inkjet head is collected by a negative-pressure tank which is the downstream ink tank. The ink stored in the negative-pressure tank is fed to the positive-pressure tank by an ink pump. When the amount of circulating ink decreases, the ink is supplied from an ink cartridge to the negative-pressure tank.

In order for the inkjet head to normally perform ink ejection, a pressure (nozzle pressure) applied to nozzles of the inkjet head needs to be maintained at an appropriate negative pressure. The ink circulation type inkjet printer controls the nozzle pressure by controlling the pressures in the positive-pressure tank and the negative-pressure tank.

An ink circulation type inkjet printer achieving color printing by using inks of multiple colors includes an ink circulation mechanism for each color. Such an inkjet printer needs to be provided with pressure adjustment mechanisms for respective colors so that the pressures of the positive-pressure tanks and the negative-pressure tanks during the ink circulation mechanisms of the respective colors can be controlled color by color. This increases the size of the printer.

In view of this Japanese Unexamined Patent Application Publication No. 2011-167873 proposes a technique in which a common air chamber communicating with the positive-pressure tanks of the respective colors and a common air chamber communicating with the negative-pressure tanks of the respective colors are provided, and the pressures in the positive-pressure tanks of the respective colors and the negative-pressure tanks of the respective colors are controlled through the common air chambers.

SUMMARY

When the ink circulation type inkjet printer is performing printing while circulating the inks, the liquid level of the ink in each of the ink tanks fluctuates due to flow-in and flow-out of the ink.

For example, in each of the negative-pressure tanks, the liquid level fluctuates due to flow-in of the ink not consumed in the inkjet head and ink supply from the ink cartridge. The liquid level tends to abruptly fluctuate particularly when the ink is supplied from the ink cartridge. This is because, in order to prevent ink shortage, an ink conduit having low flow path resistance is provided between the ink cartridge and the negative-pressure tank, and the negative-pressure tank can be supplied with the ink instantaneously via the ink conduit.

In the configuration in which the inkjet printer having the ink circulation mechanisms of multiple colors includes the common air chamber communicating with the negative-pressure tanks of the respective colors, the negative-pressure tanks communicate with each other via the common air chamber in an air-tight state during the ink circulation. When the ink is supplied from the ink cartridge to one of the negative-pressure tanks, the liquid level in this negative-pressure tank abruptly rises, and this pressure rise compresses air in the common air chamber and air spaces in the negative-pressure tanks of the respective colors. This causes the pressures in the common air chamber and the negative-pressure tanks of the respective colors to abruptly fluctuate.

When the inks are simultaneously supplied from the ink cartridges to the negative-pressure tanks of the multiple colors, the fluctuation of the pressures in the common air chamber and the negative-pressure tanks of the respective colors is so great that the nozzle pressures in the inkjet heads of the respective colors may abruptly and greatly fluctuate.

As described above, in a case where the pressures in the ink tanks of the respective colors are controlled by using the common air chamber, the nozzle pressures in the inkjet heads of the respective colors may abruptly and greatly fluctuate by the effect of the liquid levels fluctuating simultaneously in the ink tanks of the ink circulation mechanisms of the multiple colors. As a result, there is a possibility that abnormal ink ejection occurs and the printed image quality decreases.

An object of the present invention is to provide an inkjet printer capable of alleviating a decrease in the printed image quality.

An inkjet printer in accordance with some embodiments includes a plurality of printing units, a negative-pressure adjuster, and a controller. Each of the plurality of printing units includes an inkjet head having nozzles for ejecting an ink therefrom, a first tank configured to store the ink to be supplied to the inkjet head, a second tank configured to receive the ink not consumed in the inkjet head, a circulation path configured to allow the ink to circulate among the first tank, the inkjet head, and the second tank, an ink pump configured to feed the ink from the second tank to the first tank, and an ink supply unit configured to supply the ink to the second tank. The negative-pressure adjuster includes a negative-pressure common air chamber in communication with the second tanks of the plurality of printing units, and a negative-pressure applying unit configured to apply a negative pressure force to the second tanks of the plurality of printing units and the negative-pressure common air chamber. The controller is configured to control the plurality of printing units and the negative-pressure adjuster. Upon supply of the inks to the second tanks of the plurality of printing units with the second tanks in communication with each other via the negative-pressure common air chamber in an air-tight state and with the negative-pressure force applied to the second tanks and the negative-pressure common air chamber, the controller is configured to drive the ink supply units of the plurality of printing units to supply the inks such that times in which the inks flow into the second tanks in the plurality of printing units do not coincide with each other.

According to the configuration described above, the controller controls the ink supply units of the plurality of printing units such that the times in which the inks flow into the second tanks of the plurality of printing units do not coincide with each other in the ink supply. This can reduce a case where the liquid levels fluctuate simultaneously in the second tanks of the plurality of printing units. Accordingly, it is possible to suppress a case where the nozzle pressures of the inkjet heads in the plurality of printing units fluctuate abruptly and greatly. As a result, it is possible to reduce abnormal ejection of the inks and alleviate a decrease of the printed image quality.

The controller may be configured to drive the ink supply units to perform an intermittent ink supply operation in the supply of the inks.

According to the configuration described above, performing the intermittent ink supply operation can make the liquid level fluctuation in the second tanks milder. Abrupt fluctuation of the nozzle pressures of the inkjet heads can be thereby further suppressed.

The inkjet printer may further include an ink supply rate information obtaining unit configured to obtain information indicating ink supply rates in ink supply operations of the ink supply units. The controller may be configured to determine a continuous ink supply time in the intermittent ink supply operation, based on the information obtained by the ink supply rate information obtaining unit.

According to the configuration described above, the controller controls the continuous ink supply time in the intermittent ink supply operation, based on the information indicating an ink supply rate in the ink supply operation. This can suppress an increase of the liquid level fluctuation in the second tanks due to change in the ink supply rate. As a result, abrupt fluctuation of the nozzle pressure of the inkjet head can be further suppressed.

The inkjet printer may further include a positive-pressure adjuster including a positive-pressure common air chamber in communication with the first tanks of the plurality of printing units and a positive-pressure applying unit configured to apply a positive-pressure force to the first tanks of the plurality of printing units and the positive-pressure common air chamber. Upon feeding of the inks from the second tanks to the first tanks of the plurality of printing units with the first tanks in communication with each other via the positive-pressure common air chamber in an air-tight state and with the positive-pressure force applied to the first tanks and the positive-pressure common air chamber, the controller may be configured to drive the ink pumps of the plurality of printing units to feed the inks such that times in which the inks flow into the first tanks in the plurality of printing units do not coincide with each other.

According to the configuration described above, the controller controls the ink pumps of the plurality of printing units such that the times in which the inks flow into the first tanks in the plurality of printing units do not coincide with each other. This can reduce a case where the liquid levels fluctuate simultaneously in the first tanks of the plurality of printing units. Accordingly, it is possible to suppress a case where the nozzle pressures of the inkjet heads in the plurality of printing units fluctuate abruptly and greatly in the feeding to the first tanks. As a result, it is possible to reduce abnormal ejection of the inks and alleviate the decrease of the printed image quality.

The controller may be configured to drive the ink pumps to perform an intermittent feeding operation in the feeding of the inks from the second tanks to the first tanks.

According to the configuration described above, performing the intermittent ink feeding operation in the ink feeding to the first tanks can make the liquid level fluctuation in the first tanks milder. Abrupt fluctuation of the nozzle pressures of the inkjet heads can be thereby further suppressed.

The inkjet printer may further include an ink flow-in rate information obtaining unit configured to obtain information indicating flow-in rates of the inks into the first tanks in the feeding of the inks from the second tanks to the first tanks. The controller may be configured to determine a continuous feeding time in the intermittent feeding operation, based on the information obtained by the ink flow-in rate information obtaining unit.

According to the configuration described above, the controller controls the continuous feeding time in the intermittent feeding operation, based on the information indicating flow-in rates of the inks into the first tanks. This can suppress an increase of the liquid level fluctuation in the first tanks due to change in the flow-in rates of the inks into the first tanks. As a result, abrupt fluctuation of the nozzle pressures of the inkjet heads can be further suppressed.

The inkjet printer may further include a positive-pressure common air chamber in communication with the first tanks of the plurality of printing units. The controller may be configured to: in a printing operation, drive the ink pumps with the first tanks in communication with each other via the positive-pressure common air chamber in an air-tight state to feed the inks from the second tanks to the first tanks in the plurality of printing units, apply a positive-pressure force to the first tanks and the positive-pressure common air chamber, and maintain the positive-pressure force as applied; and drive the ink pumps of the plurality of printing units out of phase with each other.

According to the configuration described above, in a case of driving the ink pumps of the plurality of printing units, the controller drives the ink pumps of the plurality of printing units out of phase with each other. This can suppress an increase of the pressure fluctuation in the first tanks of the plurality of printing units and the positive-pressure common air chamber which is caused by overlapping of pulsation of the ink pumps in the plurality of printing units. As a result, it is possible to reduce abnormal ejection of the inks due to fluctuation of the nozzle pressure of the inkjet heads in the plurality of printing units and alleviate the decrease of the printed image quality.

An inkjet printer in accordance with some embodiments includes: a plurality of printing units, a positive-pressure adjuster, and a controller. Each of the plurality of printing units includes an inkjet head having nozzles for ejecting an ink therefrom, a first tank configured to store the ink to be supplied to the inkjet head, a second tank configured to receive the ink not consumed in the inkjet head, a circulation path configured to allow the ink to circulate among the first tank, the inkjet head, and the second tank, an ink pump configured to feed the ink from the second tank to the first tank, and an ink supply unit configured to supply the ink to the second tank. The positive-pressure adjuster includes a positive-pressure common air chamber in communication with the first tanks of the plurality of printing units, and a positive-pressure applying unit configured to apply a positive-pressure force to the first tanks of the plurality of printing units and the positive-pressure common air chamber. The controller is configured to control the plurality of printing units and the positive-pressure adjuster. Upon feeding of the inks from the second tanks to the first tanks of the plurality of printing units with the first tanks in communication with each other via the positive-pressure common air chamber in an air-tight state and with the positive-pressure force applied to the first tanks and the positive-pressure common air chamber, the controller is configured to drive the ink pumps of the plurality of printing units to feed the inks such that times in which the inks flow into the first tanks in the plurality of printing units do not coincide with each other.

According to the configuration described above, in a case of feeding the inks from the second tanks to the first tanks, the controller controls the ink pumps of the plurality of printing units such that the times in which the inks flow into the first tanks in the plurality of printing units do not coincide with each other. This can reduce a case where the liquid levels fluctuate simultaneously in the first tanks of the plurality of printing units. Accordingly, it is possible to suppress a case where the nozzle pressures of the inkjet heads in the plurality of printing units fluctuate abruptly and greatly. As a result, it is possible to reduce abnormal ejection of the inks and alleviate the decrease of the printed image quality.

DETAILED DESCRIPTION

Figure 1:
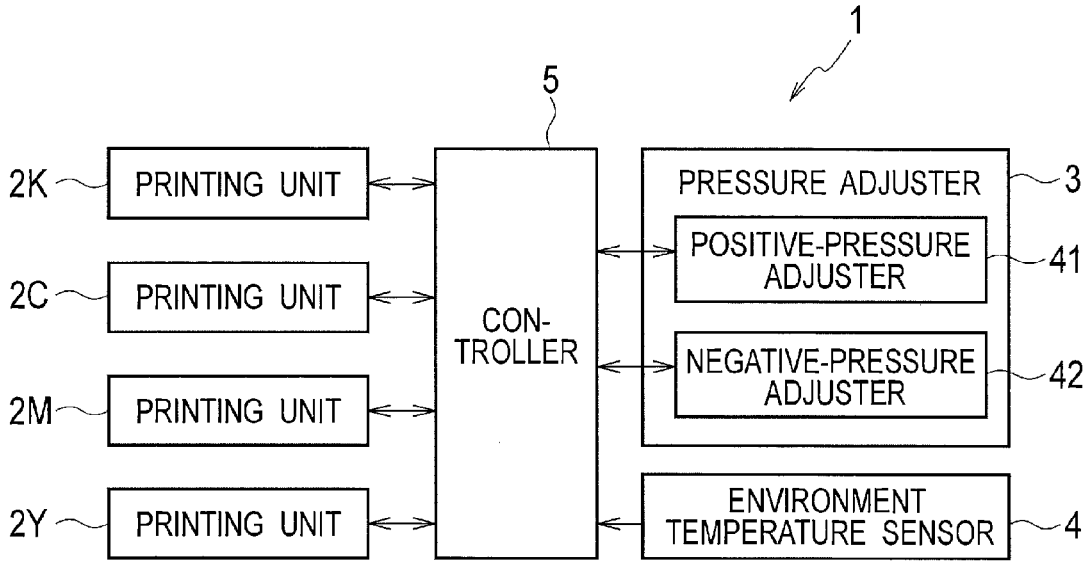
FIG. 1 is a block diagram showing a configuration of an inkjet printer in a first embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

First Embodiment

Figure 2:
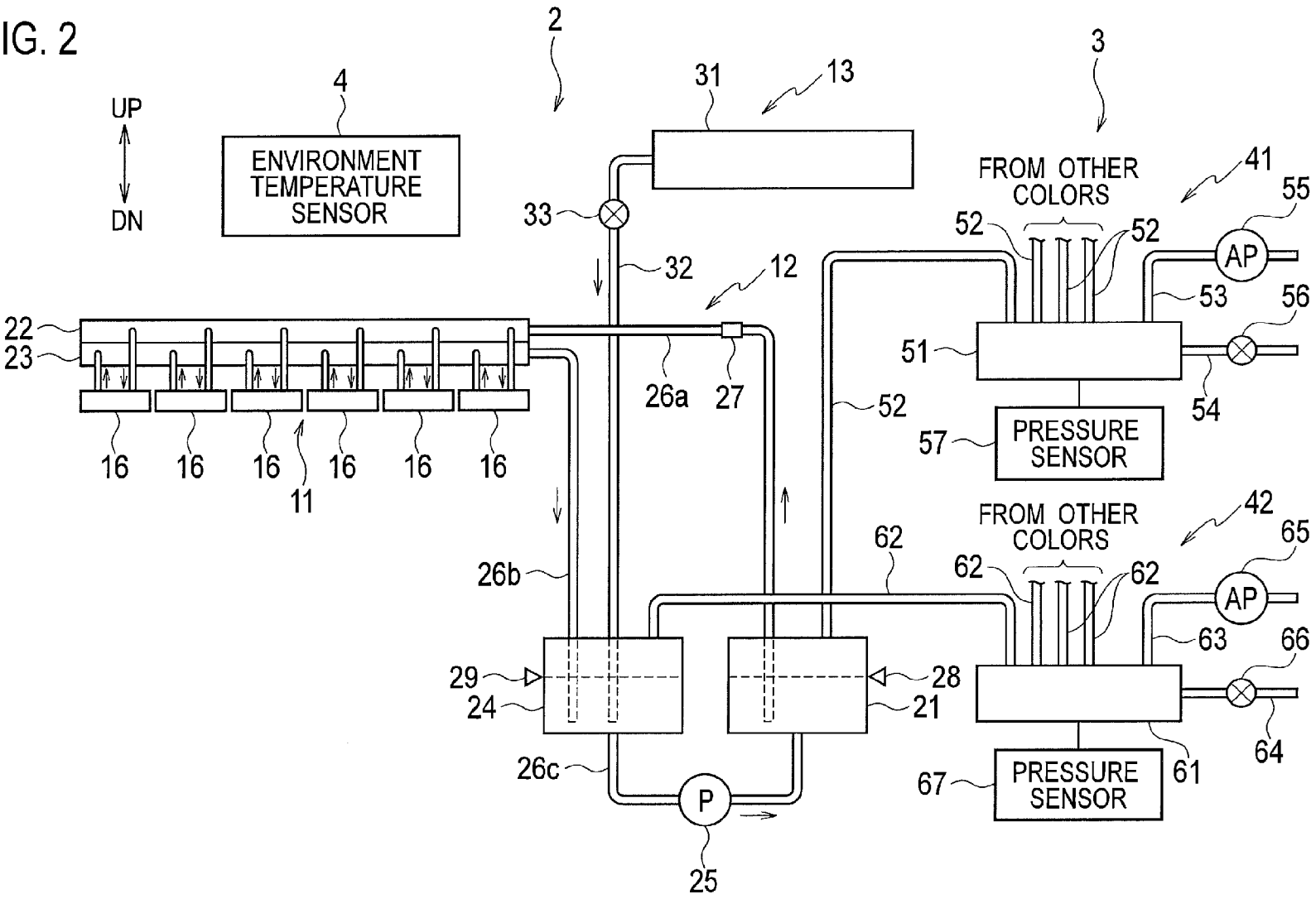
FIG. 2 is a schematic configuration diagram of a printing unit and a pressure adjuster of the inkjet printer shown in FIG. 1.

FIG. 1 is a block diagram showing a configuration of an inkjet printer 1 in a first embodiment of the present invention. FIG. 2 is a schematic configuration diagram of printing units 2K, 2C, 2M, and 2Y and a pressure adjuster 3 in the inkjet printer 1 shown in FIG. 1. Note that up-down directions in the following description are vertical directions and UP and DN in FIG. 2 denote an upward direction and a downward direction, respectively.

As shown in FIG. 1, the inkjet printer 1 of the first embodiment includes the printing units 2K, 2C, 2M, and 2Y, the pressure adjuster 3, an environment temperature sensor 4, and a controller 5.

The printing units 2K, 2C, 2M, and 2Y print an image by ejecting inks onto a not-illustrated sheet while circulating the inks. The printing units 2K, 2C, 2M, and 2Y eject inks of black (K), cyan (C), magenta (M), and yellow (Y), respectively. The printing units 2K, 2C, 2M, and 2Y have the same configuration except for the colors of inks ejected therefrom. Accordingly, the printing units 2K, 2C, 2M, and 2Y are sometimes collectively described by omitting the alphabets (K, C, M, and Y) which are attached to the reference numerals and which indicate the colors.

As shown in FIG. 2, the printing units 2 each include an inkjet head 11, an ink circulation unit 12, and an ink supply unit 13.

The inkjet head 11 ejects the ink supplied by the ink circulation unit 12. The inkjet head 11 includes multiple head modules 16.

The head modules 16 are piezoelectric head modules. Each head module 16 has an ink chamber for storing the ink and multiple nozzles for ejecting the ink (both are not illustrated). A piezoelectric element (not illustrated) is disposed inside the ink chamber. The ink is ejected from the nozzles by the drive of the piezoelectric element.

The ink circulation unit 12 supplies the ink to the inkjet head 11 while circulating the ink. The ink circulation unit includes a positive-pressure tank (first tank) 21, a distributor 22, a collector 23, a negative-pressure tank (second tank) 24, an ink pump 25, an ink conduits 26*a*, 26*b*, and 26*c*, and an ink temperature sensor 27.

The positive-pressure tank 21 stores the ink to be supplied to the inkjet head 11. The positive-pressure tank 21 is disposed at a position below the inkjet head 11. The ink in the positive-pressure tank 21 is supplied to the inkjet head 11 via the ink conduit 26*a* and the distributor 22. An air space (air layer) is formed above a liquid level of the ink in the positive-pressure tank 21. The positive-pressure tank 21 communicates with a positive-pressure common air chamber 51 to be described later via an air conduit 52 to be described later. A positive-pressure tank liquid level sensor 28 is provided in the positive-pressure tank 21.

The positive-pressure tank liquid level sensor 28 is a sensor for detecting whether the height of the liquid level of the ink inside the positive-pressure tank 21 is equal to or higher than a reference height. When the height of the liquid level of the ink inside the positive-pressure tank 21 is equal to or greater than the reference height, the positive-pressure tank liquid level sensor 28 outputs a signal indicating "ON." Meanwhile, when the height of the liquid level is lower than the reference height, the positive-pressure tank liquid level sensor 28 outputs a signal indicating "OFF."

The distributor 22 distributes the ink supplied from the positive-pressure tank 21 via the ink conduit 26*a* to the head modules 16 in the inkjet head 11.

The collector 23 collects the ink not consumed in the inkjet head 11, from the head modules 16. The ink collected by the collector 23 flows to the negative-pressure tank 24 via the ink conduit 26*b*.

The negative-pressure tank 24 receives the ink not consumed in the inkjet head 11 from the collector 23. Moreover, the negative-pressure tank 24 stores the ink supplied from an ink cartridge in the ink supply unit 13 to be described later. An air space (air layer) is formed above the liquid level of the ink inside the negative-pressure tank 24. The negative-pressure tank 24 communicates with a negative-pressure common air chamber 61 to be described later via an air conduit 62 to be described later. The negative-pressure tank 24 is disposed at the same height as the positive-pressure tank 21. A negative-pressure tank liquid level sensor 29 is provided in the negative-pressure tank 24.

The negative-pressure tank liquid level sensor 29 is a sensor for detecting whether the height of the liquid level of the ink inside the negative-pressure tank 24 is equal to or higher than a reference height. When the height of the liquid level of the ink inside the negative-pressure tank 24 is equal to or higher than the reference height, the negative-pressure tank liquid level sensor 29 outputs a signal indicating "ON." Meanwhile, when the height of the liquid level is lower than the reference height, the negative-pressure tank liquid level sensor 29 outputs a signal indicating "OFF."

The ink pump 25 feeds the ink from the negative-pressure tank 24 to the positive-pressure tank 21. The ink pump 25 is provided in the middle of the ink conduit 26*c*.

The ink conduit 26*a* connects the positive-pressure tank 21 and the distributor 22 to each other. The ink flows through the ink conduit 26*a* from the positive-pressure tank 21 toward the distributor 22. The ink conduit 26*b* connects the collector 23 and the negative-pressure tank 24 to each other. The ink flows through the ink conduit 26*b* from the collector 23 toward the negative-pressure tank 24. The ink conduit 26*c* connects the negative-pressure tank 24 and the positive-pressure tank 21 to each other. The ink flows through the ink conduit 26*c* from the negative-pressure tank 24 toward the positive-pressure tank 21. The ink conduits 26*a* to 26*c*, the distributor 22, and the collector 23 form a circulation path through which the ink is circulated among the positive-pressure tank 21, the inkjet head 11, and the negative-pressure tank 24.

The ink temperature sensor 27 detects the temperature of the ink inside the ink circulation unit 12. The ink temperature sensor 27 is provided in the middle of the ink conduit 26*a*. The ink temperature sensor 27 can be installed at any location as long as the temperature of the ink inside the ink circulation unit 12 is detectable.

The ink supply unit 13 supplies the ink to the ink circulation unit 12. The ink supply unit 13 includes an ink cartridge 31, an ink conduit 32, and an ink supply valve 33.

The ink cartridge 31 stores the ink to be used for printing in the printing unit 2. The ink inside the ink cartridge 31 is supplied to the negative-pressure tank 24 via the ink conduit 32.

The ink conduit 32 connects the ink cartridge 31 and the negative-pressure tank 24 to each other. The ink flows through the ink conduit 32 from the ink cartridge 31 toward the negative-pressure tank 24. The ink conduit 32 is formed of a pipe whose flow path resistance is smaller than those of the ink conduits 26*a* to 26*c*. Such a pipe is used to allow the ink to be supplied at high speed and prevent ink shortage during the ink circulation unit 12.

The ink supply valve 33 opens and closes a flow path of the ink inside the ink conduit 32. The ink supply valve 33 is a normally-closed solenoid valve which is set to a closed state when no electricity is supplied and which is set to an open state when electricity is supplied.

The pressure adjuster 3 adjusts the pressures in the positive-pressure tanks 21 and the air spaces in the negative-pressure tanks 24 of the printing units 2. The pressure adjuster 3 thereby causes the inks to circulate inside the ink circulation units 12 of the respective printing units 2 and also adjusts the nozzle pressures of the inkjet heads 11. The pressure adjuster 3 includes a positive-pressure adjuster 41 and a negative-pressure adjuster 42.

The positive-pressure adjuster 41 adjusts the pressures in the air spaces of the positive-pressure tanks 21 of the respective printing units 2. The positive-pressure adjuster 41 includes the positive-pressure common air chamber 51, four air conduits 52, air conduits 53 and 54, an air pump (pressure applying unit) 55, a positive-pressure atmosphere release valve 56, and a pressure sensor 57.

The positive-pressure common air chamber 51 is an air chamber for equalizing the pressures (positive pressures) in the positive-pressure tanks 21 of the respective printing units 2. The positive-pressure common air chamber 51 communicates with the air spaces of the positive-pressure tanks 21 of the printing units 2K, 2C, 2M, and 2Y via the four air conduits 52. This allows the air space of the positive-pressure tank 21 of each printing unit 2 to communicate with the air spaces of the other positive-pressure tanks 21 via the positive-pressure common air chamber 51 and the air conduits 52.

The air conduits 52 connect the positive-pressure common air chamber 51 and the air spaces of the positive-pressure tanks 21 to one another.

The air conduit 53 forms a flow path for air to be fed to the positive-pressure common air chamber 51 by the air pump 55. One end of the air conduit 53 is connected to the positive-pressure common air chamber 51 and the other end communicates with the atmosphere.

The air conduit 54 forms a flow path of air to allow the positive-pressure common air chamber 51 to be opened to the atmosphere. One end of the air conduit 54 is connected to the positive-pressure common air chamber 51 and the other end communicates with the atmosphere.

The air pump 55 feeds air to the positive-pressure common air chamber 51 via the air conduit 53 and pressurizes the positive-pressure common air chamber 51 and the positive-pressure tanks 21 of the respective printing units 2. The air pump 55 is disposed in the middle of the air conduit 53.

The positive-pressure atmosphere release valve 56 opens and closes the flow path of air inside the air conduit 54. When the positive-pressure atmosphere release valve 56 is opened, the positive-pressure common air chamber 51 is opened to the atmosphere. The positive-pressure atmosphere release valve 56 is formed of a normally-open solenoid valve which is set to an open state when no electricity is supplied thereto and which is set to a closed state when electricity is supplied thereto.

The pressure sensor 57 detects the pressure inside the positive-pressure common air chamber 51.

The negative-pressure adjuster 42 adjusts the pressures in the air spaces of the negative-pressure tanks 24 of the respective printing units 2. The negative-pressure adjuster 42 includes a negative-pressure common air chamber 61, four air conduits 62, air conduits 63 and 64, an air pump (negative-pressure applying unit) 65, an negative-pressure atmosphere release valve 66, and a pressure sensor 67.

The negative-pressure common air chamber 61 is an air chamber for equalizing the pressures (negative pressures) in the negative-pressure tanks 24 of the respective printing units 2. The negative-pressure common air chamber 61 communicates with the air spaces of the negative-pressure tanks 24 of the printing units 2K, 2C, 2M, and 2Y via the four air conduits 62. This allows the air space of the negative-pressure tank 24 of each printing unit 2 to communicate with the air spaces of the other negative-pressure tanks 24 via the negative-pressure common air chamber 61 and the air conduits 62.

The air conduits 62 connect the negative-pressure common air chamber 61 and the air spaces of the negative-pressure tanks 24 to one another.

The air conduit 63 forms a flow path for air to be sent out from the negative-pressure common air chamber 61 by the air pump 65. One end of the air conduit 63 is connected to the negative-pressure common air chamber 61 and the other end communicates with the atmosphere.

The air conduit 64 forms a flow path of air to allow the negative-pressure common air chamber 61 to be opened to the atmosphere. One end of the air conduit 64 is connected to the negative-pressure common air chamber 61 and the other end communicates with the atmosphere.

The air pump 65 sucks air from the negative-pressure common air chamber 61 via the air conduit 63 and applies negative pressure forces to the negative-pressure common air chamber 61 and the negative-pressure tanks 24 of the respective printing units 2. The air pump 65 is disposed in the middle of the air conduit 63.

The negative-pressure atmosphere release valve 66 opens and closes the flow path of air inside the air conduit 64. When the negative-pressure atmosphere release valve 66 is opened, the negative-pressure common air chamber 61 is opened to the atmosphere. The negative-pressure atmosphere release valve 66 is formed of a normally-open solenoid valve.

The pressure sensor 67 detects the pressure inside the negative-pressure common air chamber 61.

The environment temperature sensor 4 detects the environment temperature inside the inkjet printer 1.

The controller 5 controls operations of various parts of the inkjet printer 1. The controller 5 includes a CPU and a storage unit such as a RAM, a ROM, a hard disk drive, and the like. The controller 5 implements control (functions) described below by executing necessary programs stored in the storage unit and used in this printer.

In a case of starting printing, the controller 5 controls the pressure adjuster 3 to apply a positive-pressure force to the positive-pressure tank 21 and apply a negative-pressure force to the negative-pressure tank 24 in each of the printing units 2. This generates a flow of ink from the positive-pressure tank 21 toward the negative-pressure tank 24 via the inkjet head 11 and ink circulation starts.

After the ink circulation starts, the controller 5 performs printing by driving the inkjet head 11 based on a print job. In the printing operation (ink circulation), the controller 5 controls the ink supply valve 33 to supply the ink from the ink cartridge 31 to the negative-pressure tank 24 when the positive-pressure tank liquid level sensor 28 and the negative-pressure tank liquid level sensor 29 are off. Meanwhile, the controller 5 performs control such that the ink pump 25 feeds the ink from the negative-pressure tank 24 to the positive-pressure tank 21 when the negative-pressure tank liquid level sensor 29 is on and the positive-pressure tank liquid level sensor 28 is off.

In the ink supply to the negative-pressure tank 24, the controller 5 controls the ink supply units 13 of the respective printing units 2 such that the times in which the inks flow into the negative-pressure tanks 24 in the respective printing units 2 do not coincide with one another. Moreover, in the ink feeding from the negative-pressure tanks 24 to the positive-pressure tanks 21, the controller 5 controls the ink pumps 25 of the respective printing units 2 such that the times in which the inks flow into the positive-pressure tanks 21 in the respective printing units 2 do not coincide with one another.

Next, an operation of the inkjet printer 1 is described.

When the print job is inputted, the controller 5 closes the positive-pressure atmosphere release valve 56 and the negative-pressure atmosphere release valve 66. Closing the positive-pressure atmosphere release valve 56 causes the positive-pressure tanks 21 of the respective printing units 2 to communicate with each other via the positive-pressure common air chamber 51 in an air-tight state. Moreover, closing the negative-pressure atmosphere release valve 66 causes the negative-pressure tanks 24 of the respective printing units 2 to communicate with each other via the negative-pressure common air chamber 61 in the air-tight state.

Next, the controller 5 applies the positive-pressure force to the positive-pressure common air chamber 51 and the positive-pressure tanks 21 of the respective printing units 2. Specifically, the controller 5 starts the drive of the air pump 55 in the positive-pressure adjuster 41 to send air to the positive-pressure common air chamber 51. This pressurizes the positive-pressure common air chamber 51 and the positive-pressure tanks 21 of the respective printing units 2. The controller 5 stops the air pump 55 when a detection value of the pressure sensor 57 in the positive-pressure adjuster 41 reaches a reference value for the positive-pressure force. The inkjet printer 1 is thereby set to a state where the positive-pressure force of the reference value is applied to the positive-pressure common air chamber 51 and the positive-pressure tanks 21 of the respective printing units 2.

The reference value of the positive-pressure force described above and a reference value of the negative-pressure force to be described later are values set in advance as values for setting the nozzle pressure of each inkjet head 11 within an appropriate range.

The controller 5 applies the negative-pressure force to the negative-pressure common air chamber 61 and the negative-pressure tanks 24 of the respective printing units 2 in parallel with the aforementioned application of the positive-pressure force to the positive-pressure common air chamber 51 and the positive-pressure tanks 21 of the respective printing units 2. Specifically, the controller 5 starts the drive of the air pump 65 in the negative-pressure adjuster 42 to suck air from the negative-pressure common air chamber 61. This reduces the pressure in the negative-pressure common air chamber 61 and the negative-pressure tanks 24 of the respective printing units 2. The controller 5 stops the air pump 65 when a detection value of the pressure sensor 67 in the negative-pressure adjuster 42 reaches the reference value of the negative-pressure force. The inkjet printer 1 is thereby set to a state where the negative-pressure force of the reference value is applied to the negative-pressure common air chamber 61 and the negative-pressure tanks 24 of the respective printing units 2.

The application of the positive-pressure force to the positive-pressure tanks 21 and the negative-pressure to the negative-pressure tanks 24 in the respective printing units 2 causes the inks to flow from the positive-pressure tanks 21 toward the negative-pressure tanks 24 via the inkjet heads 11, and the ink circulation starts. After the ink circulation starts, the controller 5 drives the inkjet heads 11 based on the print job and performs printing.

In the printing operation (ink circulation), the controller 5 controls the ink feeding to each positive-pressure tank 21 and the ink supply to each negative-pressure tank 24 according to the on/off states of the corresponding positive-pressure tank liquid level sensor 28 and the corresponding negative-pressure tank liquid level sensor 29.

Control of the feeding to the positive-pressure tank 21 and the ink supply to the negative-pressure tank 24 according to the state of the positive-pressure tank liquid level sensor 28 and the negative-pressure tank liquid level sensor 29 is described with reference to FIG. 3.

Figures 3, 4:
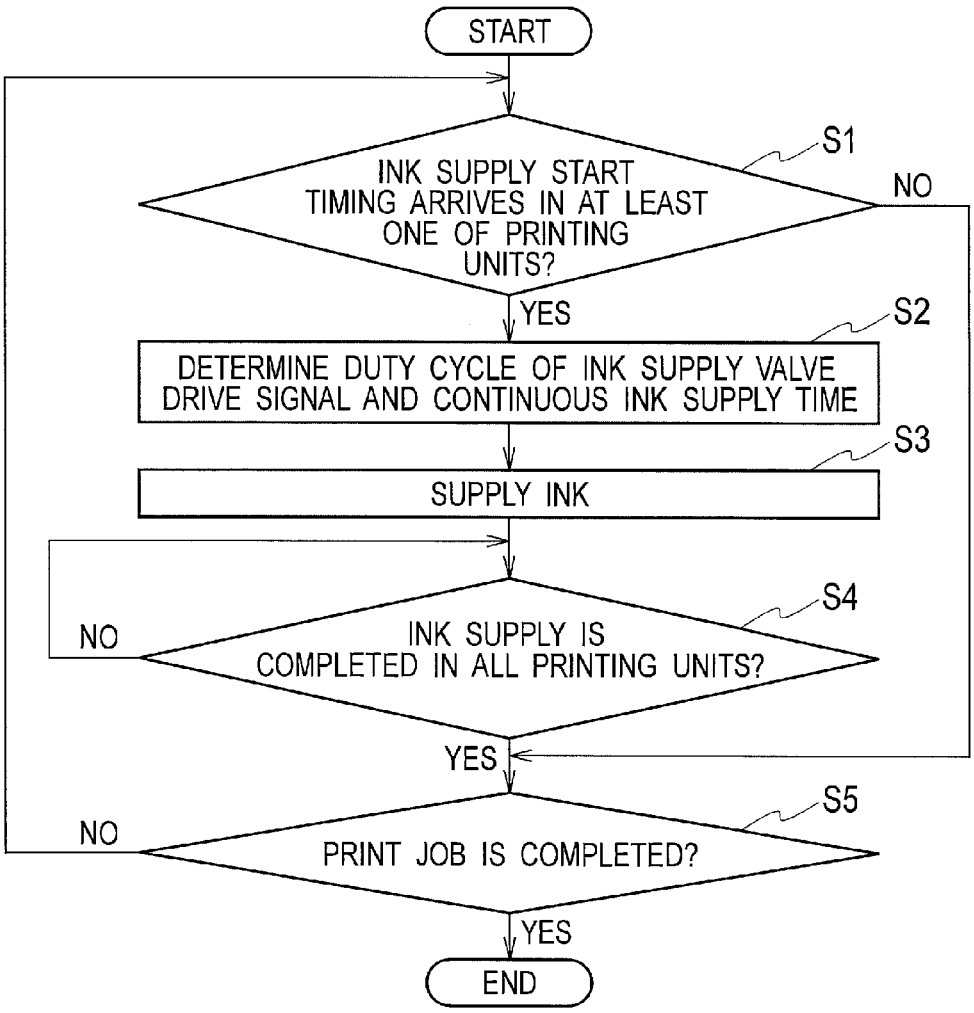
FIG. 3 is an explanatory view of control of feeding to a positive-pressure tank and ink supply depending on states of a positive-pressure tank liquid level sensor and a negative-pressure tank liquid level sensor.
FIG. 4 is a flowchart for explaining an ink supply operation.

As shown in FIG. 3, in a state where both of the positive-pressure tank liquid level sensor 28 and the negative-pressure tank liquid level sensor 29 are on, the controller 5 does not perform the feeding to the positive-pressure tank 21 or the ink supply to the negative-pressure tank 24.

In a state where the positive-pressure tank liquid level sensor 28 is off and the negative-pressure tank liquid level sensor 29 is on, the controller 5 controls the ink pump 25 to perform the feeding to the positive-pressure tank 21. In this state, the controller 5 does not perform the ink supply to the negative-pressure tank 24.

In a state where the positive-pressure tank liquid level sensor 28 is on and the negative-pressure tank liquid level sensor 29 is off, the controller 5 does not perform the feeding to the positive-pressure tank 21 or the ink supply to the negative-pressure tank 24.

In a state where both of the positive-pressure tank liquid level sensor 28 and the negative-pressure tank liquid level sensor 29 are off, the controller 5 controls the ink supply valve 33 to perform the ink supply to the negative-pressure tank 24. In this state, the controller 5 does perform the feeding to the positive-pressure tank 21.

For example, when the ink circulation for the printing starts in a state where the positive-pressure tank liquid level sensor 28 and the negative-pressure tank liquid level sensor 29 are both on, the ink flows out from the positive-pressure tank 21 to toward the inkjet head 11 and the positive-pressure tank liquid level sensor 28 eventually switches to the off state. The controller 5 thereby controls the ink pump 25 to feed the ink from the negative-pressure tank 24 to the positive-pressure tank 21.

The ink flowing in from the negative-pressure tank 24 causes the liquid level in the positive-pressure tank 21 to rise. When the positive-pressure tank liquid level sensor 28 switches to the on state, the controller 5 stops the feeding from the negative-pressure tank 24 to the positive-pressure tank 21.

When the amount of ink circulating in the inkjet head 11 and the ink circulation unit 12 decreases with the progress of the printing, the positive-pressure tank liquid level sensor 28 and the negative-pressure tank liquid level sensor 29 both eventually switch to the off state. In this state, the controller 5 controls the ink supply valve 33 and performs the ink supply to the negative-pressure tank 24.

When the negative-pressure tank liquid level sensor 29 switches to the on state due to the ink supply, the controller 5 stops the ink supply to the negative-pressure tank 24. At this time, since the positive-pressure tank liquid level sensor 28 is off and the negative-pressure tank liquid level sensor 29 is on, the controller 5 controls the ink pump 25 to feed the ink from the negative-pressure tank 24 to the positive-pressure tank 21. When the positive-pressure tank liquid level sensor 28 switches to the on state, the controller 5 stops the feeding from the negative-pressure tank 24 to the positive-pressure tank 21.

The printing is performed with the liquid levels in the positive-pressure tank 21 and the negative-pressure tank 24 being maintained near the reference heights by controlling the feeding to the positive-pressure tank 21 and the ink supply according to the states of the positive-pressure tank liquid level sensor 28 and the negative-pressure tank liquid level sensor 29 as described above.

When the print job is completed, the controller 5 opens the positive-pressure atmosphere release valve 56 and the negative-pressure atmosphere release valve 66. Opening the positive-pressure atmosphere release valve 56 causes the positive-pressure common air chamber 51 and the positive-pressure tanks 21 of the respective printing units 2 to be opened to the atmosphere. Moreover, opening the negative-pressure atmosphere release valve 66 causes the negative-pressure common air chamber 61 and the negative-pressure tanks 24 of the respective printing units 2 to be opened to the atmosphere. The ink circulation is thereby stopped and the inkjet printer 1 is set to a standby state.

Next, description is given of details of an operation in the aforementioned ink supply to the negative-pressure tank 24. FIG. 4 is a flowchart for explaining the ink supply operation. Processing shown in the flowchart of FIG. 4 starts when the inkjet printer 1 receives the print job.

In step S1 of FIG. 4, the controller 5 determines whether an ink supply start timing arrives in at least one of the printing units 2. The controller 5 determines that the ink supply start timing arrives when the positive-pressure tank liquid level sensor 28 and the negative-pressure tank liquid level sensor 29 both switch to the off state. When the controller 5 determines that the ink supply start timing arrives in none of the printing units 2 (step S1: NO), the controller 5 causes the processing to proceed to step S5 to be described later.

When the controller 5 determines that the ink supply start timing arrives in at least one of the printing units 2 (step S1: YES), the controller 5 determines a duty cycle Dv of an ink supply valve drive signal and a continuous ink supply time Tv in step S2.

When the ink supply is to be started simultaneously in multiple printing units 2, the controller 5 calculates the duty cycle Dv (%) of the ink supply valve drive signal by using the following formula (1).

$$Dv\,(\%)=(1/Nv)*100 \quad (1)$$

In this formula, Nv represents the number of multiple ink colors (the number of the printing units 2) for which the ink supply operation is to be performed simultaneously. Specifically, Nv is one of two, three, and four.

When the number of the printing units 2 in which the ink supply is to be started is one, the controller 5 determines that the duty cycle Dv of the ink supply valve drive signal is a value set in advance as a duty cycle for a case where the ink supply is performed in only one printing unit 2. For example, the controller 5 determines that the duty cycle Dv of the ink supply valve drive signal is 50%.

Figure 5:
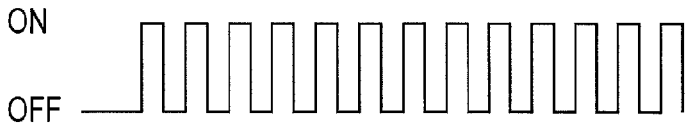
FIG. 5 is a waveform diagram of an example of an ink supply valve drive signal.

A waveform of an example of the ink supply valve drive signal is shown in FIG. 5. FIG. 5 shows a waveform of the ink supply valve drive signal whose duty cycle Dv is 50%. When the ink supply valve drive signal is on, electricity is supplied to the ink supply valve 33 and the ink supply valve 33 is set to the open state. When the ink supply valve drive signal is off, no electricity is supplied to the ink supply valve 33 and the ink supply valve 33 is set the closed state.

An intermittent ink supply operation (intermittent supply operation) is performed by such an ink supply valve drive signal. In the case of the ink supply valve drive signal of FIG. 5, there is performed an intermittent supply operation in which the open state and the closed state of the ink supply valve 33 are alternately repeated with the duration times of the open state and the closed state being the same.

The continuous ink supply time Tv is a time in which the ink supply valve 33 is set to the open state in each cycle in the intermittent supply operation by the ink supply valve drive signal. In other words, the continuous ink supply time Tv is an on-state duration time in each cycle in the ink supply valve drive signal. The controller 5 sets the continuous ink supply time Tv based on the environment temperature detected by the environment temperature sensor 4.

Specifically, the controller 5 reduces the continuous ink supply time Tv as the environment temperature becomes higher. In other words, the controller 5 reduces the on-state duration time in the ink supply valve drive signal as the environment temperature becomes higher.

The higher the environment temperature is, the higher the temperature of the ink inside the ink cartridge 31 is, and the lower the viscosity of the ink is. The lower the viscosity of the ink is, the faster the flow rate of the ink in the ink conduit 32 of the ink supply unit 13 is, i.e. the faster the ink supply rate is. Accordingly, reducing the continuous ink supply time Tv with an increase of the environment temperature can suppress an increase of the amount of the ink flowing into the negative-pressure tank 24 in one opening-closing operation of the ink supply valve 33, and suppress abrupt pressure fluctuation in the negative-pressure tank 24.

Since the ink supply rate changes depending on the environment temperature as described above, the detection temperature of the environment temperature sensor (ink supply rate information obtaining unit) 4 is information indicating the ink supply rate.

Returning to FIG. 4, in step S3 subsequent to step S2, the controller 5 controls the ink supply valve 33 in each of the printing units 2, in which the ink supply is to be performed, such that the ink is supplied to the negative-pressure tank 24. Specifically, the controller 5 controls the ink supply valve 33 in each of the printing units 2, in which the ink supply is to be performed, by using the ink supply valve drive signal corresponding to the duty cycle Dv and the continuous ink supply time Tv which are calculated in step S2.

When the number of the printing units 2 in which the ink supply is to be performed is two or more, the controller 5 performs control such that the times in which the ink supply valves 33 are set to the open state in the respective printing units 2 are shifted from each other and the times in which the inks flow into the negative-pressure tanks 24 in the respective printing units 2 are thus made not to coincide with each other.

For example, when the ink supply operation is performed simultaneously in two printing units 2, the controller 5 performs control such that an on period and an off period in the ink supply valve drive signal shown in FIG. 5 are opposite between the two printing units 2.

Figure 6:
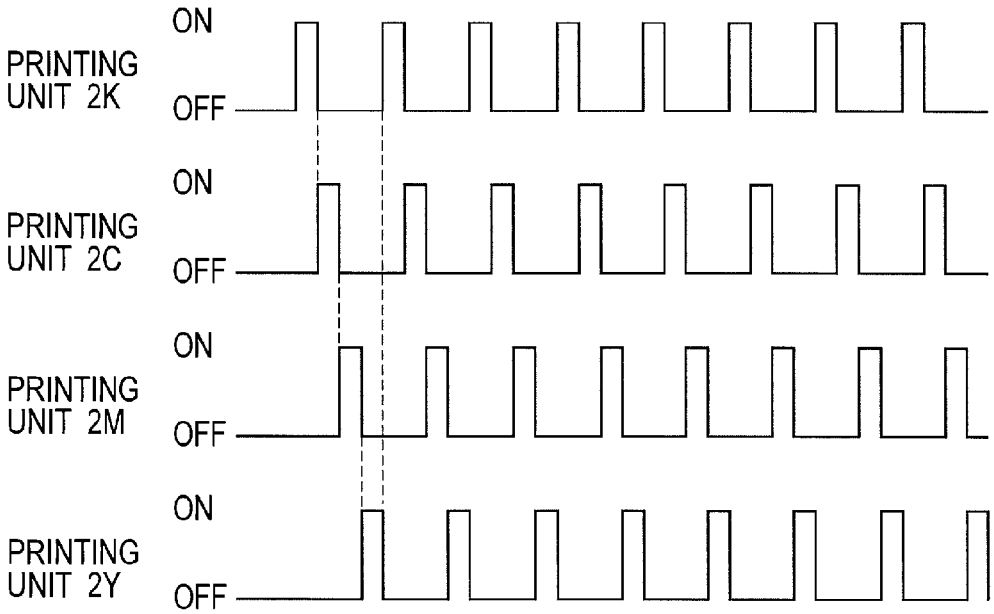
FIG. 6 is a view for explaining an example of an ink supply operation in multiple printing units.

Moreover, when the ink supply operation is performed simultaneously in, for example, four printing units 2, the controller 5 performs control such that the times in which the ink supply valves 33 are set to the open state in the respective printing units 2 are shifted from one another as shown in FIG. 6. Specifically, the controller 5 performs control such that the on periods in the ink supply valve drive signals of Dv=25% in the respective printing units 2 are shifted from one another.

The controller 5 closes the ink supply valve 33 in each printing unit 2 when the corresponding negative-pressure tank liquid level sensor 29 switches to the on state. The ink supply is thus completed.

Returning to FIG. 4, in step S4 subsequent to step S3, the controller 5 determines whether the ink supply is completed in all of the printing units 2 in which the ink supply is performed. When the controller 5 determines that there is a printing unit 2 in which the ink supply is not completed (step S4: NO), the controller 5 repeats step S4.

When the controller 5 determines that the ink supply is completed in all of the printing units 2 (step S4: YES), the controller 5 determines in step S5 whether the print job is completed. When the controller 5 determines that the print job is not completed (step S5: NO), the controller 5 causes the processing to return to step S1. When the controller 5 determines that the print job is completed (step S5: YES), the controller 5 terminates the series of processing.

There is a case where, while the ink supply is performed in some of the printing units 2, the ink supply start timing arrives in another printing unit 2 and the other printing unit 2 is added to a group of the printing units 2 in which the ink supply is performed simultaneously. In this case, the controller 5 recalculates the duty cycle Dv of the ink supply valve drive signal. Specifically, the controller 5 calculates the duty cycle Dv of the ink supply valve drive signal corresponding to the number of the printing units 2 after the addition, by using the formula (1).

Then, the controller 5 performs the ink supply by controlling the ink supply valve 33 in each of the printing units 2 including the added printing unit 2, by using the ink supply valve drive signal with the recalculated duty cycle Dv. In this case also, the controller 5 controls the ink supply valves 33 of the respective printing units 2 such that the times in which the inks flow into the negative-pressure tanks 24 in the respective printing unit 2 do not coincide with one another.

Figure 7:
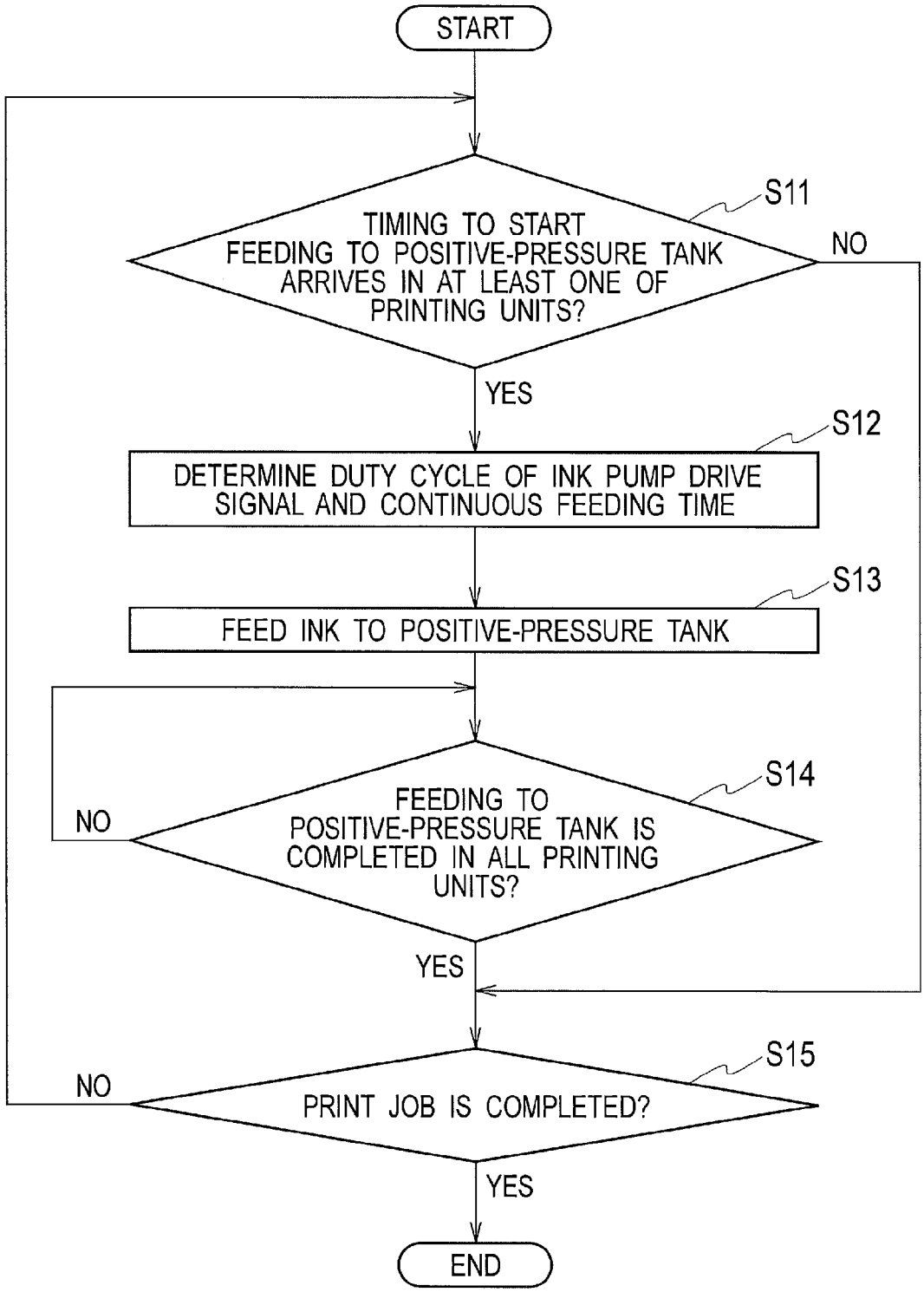
FIG. 7 is a flowchart for explaining a feeding operation of an ink to a positive-pressure tank.

Next, description is given of details of an operation in the aforementioned feeding of the ink from the negative-pressure tank 24 to the positive-pressure tank 21. FIG. 7 is a flowchart for explaining the feeding operation of the ink to the positive-pressure tank 21. Processing shown in the flowchart of FIG. 7 starts when the inkjet printer 1 receives the print job.

In step S11 of FIG. 7, the controller 5 determines whether a timing to start the feeding to the positive-pressure tank 21 arrives in at least one of the printing units 2. The controller 5 determines that the timing to start the feeding to the positive-pressure tank 21 arrives when the positive-pressure tank liquid level sensor 28 is off and the negative-pressure tank liquid level sensor 29 is on. When the controller 5 determines that the timing to start the feeding to the positive-pressure tank 21 arrives in none of the printing units 2 (step S11: NO), the controller 5 causes the processing to proceed to step S15 to be described later.

When the controller 5 determines that the timing to start the feeding to the positive-pressure tank 21 arrives in at least one of the printing units 2 (step S11, YES), the controller 5 determines a duty cycle Dp of an ink pump drive signal and a continuous feeding time Tp in step S12.

When the feeding to the positive-pressure tank 21 is to be started simultaneously in multiple printing units 2, the controller 5 calculates the duty cycle Dp (%) of the ink pump drive signal by using the following formula (2).

$$Dp\ (\%)=(1/Np)*100 \qquad (2)$$

In this formula, Np represents the number of multiple ink colors (the number of the printing units 2) for which the feed operation to the positive-pressure tank 21 is to be performed simultaneously. Specifically, Np is one of two, three, and four.

When the number of the printing units 2 in which the feeding to the positive-pressure tank 21 is to be started is one, the controller 5 determines that the duty cycle Dp of the ink pump drive signal is a value set in advance as a duty cycle for a case where the feeding to the positive-pressure tank 21 is performed in only one printing unit 2. For example, the controller 5 determines that the duty cycle Dp of the ink pump drive signal is 50%.

The ink pump drive signal is a signal having a waveform similar to those of the aforementioned ink supply valve drive signals shown in FIGS. 5 and 6 as examples, and is a signal for turning on (driving) and off (stopping) the ink pump. Intermittent feeding operation is performed by such an ink pump drive signal. For example, in a case of an ink pump drive signal whose the duty cycle Dp is 50%, there is performed an intermittent feeding operation in which the on state and the off state of the ink pump 25 are alternately repeated with the duration times of the on state and the offset being the same.

The continuous feeding time Tp is a continuous drive time of the ink pump 25 in each cycle in the intermitted feeding operation by the ink pump drive signal. In other words, the continuous feeding time Tp is an on-state duration time in each cycle in the ink pump drive signal. The controller 5 sets the continuous feeding time Tp based on the temperature of the ink during the ink circulation unit 12 detected by the ink temperature sensor 27.

The higher the temperature of the ink circulating inside the ink circulation unit 12 is, the lower the viscosity of the ink is, and the faster the flow rate of the ink in the ink conduit 26*c* is, i.e. the faster the flow-in rate of the ink into the positive-pressure tank 21 is. Accordingly, reducing the continuous feeding time Tp with an increase of the temperature of the ink inside the ink circulation unit 12 can suppress an increase of the amount of the ink flowing into the positive-pressure tank 21 in one drive operation of the ink pump 25, and suppress abrupt pressure fluctuation in the positive-pressure tank 21.

Since the flow-in rate of the ink into the positive-pressure tank 21 changes depending on the temperature of the ink inside the ink circulation unit 12 as described above, the detection temperature of the ink temperature sensor 27 is information indicating the flow-in rate of the ink into the positive-pressure tank 21 in the feeding. The ink temperature sensor 27 functions as an ink flow-in rate information obtaining unit in the claims.

In step S13 subsequent to step S12, the controller 5 controls the ink pump 25 in each of the printing units 2, in which the feeding to the positive-pressure tank 21 is to be performed, such that the feeding to the positive-pressure tank 21 is performed. Specifically, the controller 5 controls the ink pump 25 in each of the printing units 2, in which the feeding to the positive-pressure tank 21 is to be performed, by using the ink pump drive signal corresponding to the duty cycle Dp and the continuous feeding time Tp which are calculated in step S12.

When the number of the printing units 2 in which the ink feeding to the positive-pressure tank 21 is to be performed is two or more, the controller 5 performs control such that the times in which the ink pumps 25 are driven in the respective printing units 2 are shifted from each other and the times in which inks flow into the positive-pressure tanks 21 are thus made not to coincide with each other.

For example, when the feeding operation to the positive-pressure tank 21 is performed simultaneously in two printing units 2, the controller 5 performs control such that an on period and an off period in the ink pump drive signal are opposite between the two printing units 2.

Moreover, when the feeding operation to the positive-pressure tank 21 is performed simultaneously in, for example, four printing units 2, the controller 5 performs control such that the times in which the ink pumps 25 are driven in the respective printing units 2 are shifted from one another as in the case shown in FIG. 6 where the ink supply operation is performed simultaneously in the four printing units 2. Specifically, the controller 5 performs control such that the on periods in the ink pump drive signals of Dv=25% in the respective printing units 2 are shifted from one another.

The controller 5 stops the ink pump 25 in each printing unit 2 when the corresponding positive-pressure tank liquid level sensor 28 switches to the on state. The feeding to the positive-pressure tank 21 is thus completed.

In step S14 subsequent to step S13, the controller 5 determines whether the feeding is completed in all of the printing units 2 in which the feeding to the positive-pressure tank 21 is performed. When the controller 5 determines that there is a printing unit 2 in which the feeding to the positive-pressure tank 21 is not completed (step S14: NO), the controller 5 repeats step S14.

When the controller 5 determines that the feeding to the positive-pressure tank 21 is completed in all of the printing units 2 (step S14: YES), the controller 5 determines in step S15 whether the print job is completed. When the controller 5 determines that the print job is not completed (step S15: NO), the controller 5 causes the processing to return to step S11. When the controller 5 determines that the print job is completed (step S15: YES), the controller 5 terminates the series of processing.

There is a case where, while the feeding to the positive-pressure tank 21 is performed in some of the printing units 2, the timing to start the feeding to the positive-pressure tank 21 arrives in another printing unit 2 and the other printing unit 2 is added to a group of the printing units 2 in which the feeding to the positive-pressure tank 21 is performed simultaneously. In this case, the controller 5 recalculates the duty cycle Dp of the ink pump drive signal. Specifically, the controller 5 calculates the duty cycle Dp of the ink pump drive signal corresponding to the number of the printing units 2 after the addition, by using the formula (2).

Then, the controller 5 performs the feeding to the positive-pressure tank 21 by controlling the ink pump 25 in each of the printing units 2 including the added printing unit 2, by using the ink pump drive signal with the recalculated duty cycle Dp. In this case also, the controller 5 controls the ink pumps 25 of the respective printing units 2 such that the times in which the inks flow into the positive-pressure tanks 21 in the respective printing units 2 do not coincide with one another.

As described above, in the inkjet printer 1, the controller 5 controls the ink supply units 13 of the respective printing units 2 such that the times in which the inks flow into the negative-pressure tanks 24 in the respective printing units 2 do not coincide with one another in the ink supply to the negative-pressure tanks 24. Moreover, the controller 5 controls the ink pumps 25 of the respective printing units 2 such that the times in which the inks flow into the positive-pressure tanks 21 in the respective printing units 2 do not coincide with one another in the feeding of the ink from the negative-pressure tank 24 to the positive-pressure tank 21.

This can reduce a case where the liquid levels fluctuate simultaneously in the positive-pressure tanks 21 and the negative-pressure tanks 24 of multiple printing units 2. Accordingly, it is possible to suppress a case where the nozzle pressure of the inkjet head 11 in each printing unit 2 fluctuates abruptly and greatly. As a result, it is possible to reduce abnormal ejection of the inks and alleviate a decrease of the printed image quality.

Moreover, in the ink supply, the controller 5 controls the ink supply valve 33 of each of the ink supply units 13 such that the intermittent supply operation is performed. Furthermore, in the feeding from the negative-pressure tank 24 to the positive-pressure tank 21, the controller 5 controls each of the ink pumps 25 such that the intermittent feeding operation is performed. This can make the liquid level fluctuation in the positive-pressure tanks 21 and the negative-pressure tanks 24 milder. Abrupt fluctuation of the nozzle pressures of the inkjet heads 11 can be thereby further suppressed.

Moreover, the controller 5 controls the continuous ink supply time in the intermittent supply operation, based on the environment temperature detected by the environment temperature sensor 4. Furthermore, the controller 5 controls the continuous feeding time in the intermittent feeding operation, based on the temperatures of the inks inside the ink circulation units 12 detected by the ink temperature sensors 27. This can suppress an increase of liquid level fluctuation in the positive-pressure tanks 21 and the negative-pressure tanks 24 which is caused by change in the ink flow rate corresponding to the temperature of the ink. As a result, abrupt fluctuation of the nozzle pressures in the inkjet heads 11 can be further suppressed.

Second Embodiment

Figure 8:
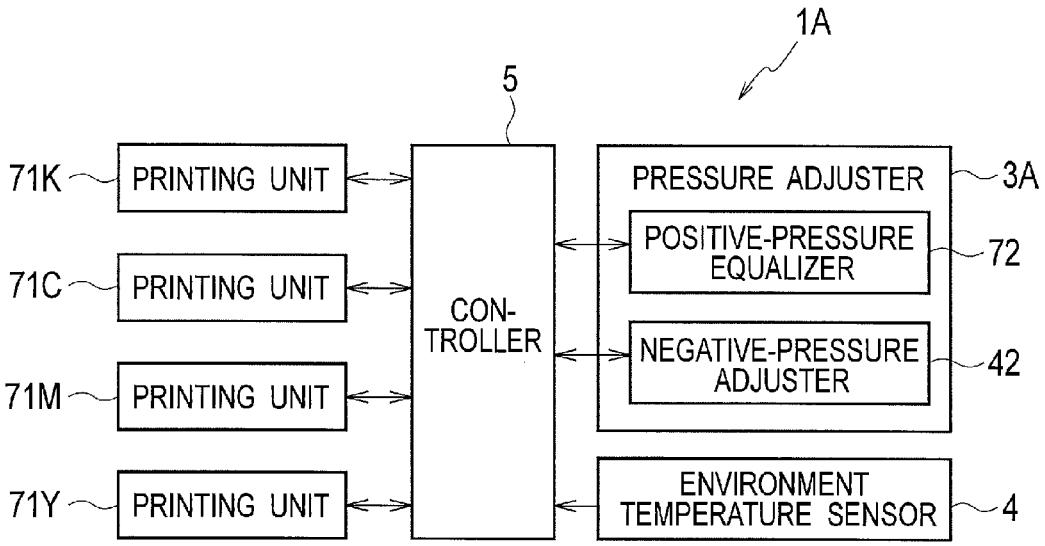
FIG. 8 is a block diagram showing a configuration of an inkjet printer in a second embodiment.
Figure 9:
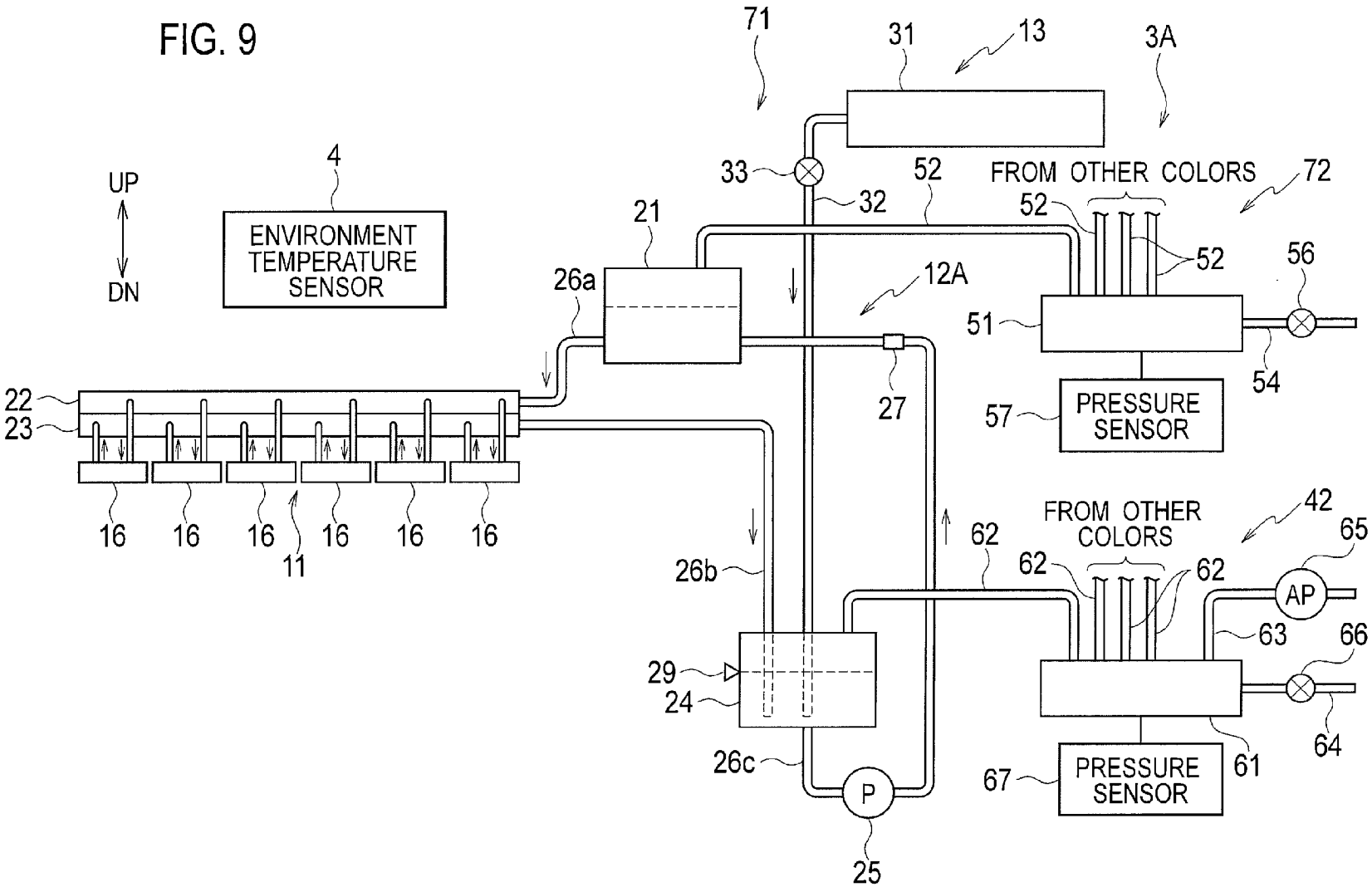
FIG. 9 is a schematic configuration diagram of a printing unit and a pressure adjuster of the inkjet printer shown in FIG. 8.

FIG. 8 is a block diagram showing a configuration of an inkjet printer 1A in a second embodiment. FIG. 9 is a schematic configuration diagram of printing units 71K, 71C, 71M, and 71Y and a pressure adjuster 3A in the inkjet printer 1A shown in FIG. 8. Note that up-down directions in the following description are vertical directions and UP and DN in FIG. 9 denote an upward direction and a downward direction, respectively.

As shown in FIG. 8, the inkjet printer 1A in the second embodiment has a configuration different from that of the inkjet printer 1 of the first embodiment shown in FIG. 1 in that the printing units 2K, 2C, 2M, and 2Y are replaced by the printing units 71K, 71C, 71M, and 71Y and the pressure adjuster 3 is replaced by the pressure adjuster 3A.

The printing units 71K, 71C, 71M, and 71Y have the same configuration except for the colors of inks ejected therefrom. Accordingly, the printing units 71K, 71C, 71M, and 71Y are sometimes collectively described by omitting the alphabets (K, C, M, and Y) which are attached to the reference numerals and which indicate the colors.

As shown in FIG. 9, each of the printing units 71 has a configuration different from that of the printing unit 2 of the first embodiment shown in FIG. 2 in that the ink circulation unit 12 is replaced by an ink circulation unit 12A.

The ink circulation unit 12A is different from the ink circulation unit 12 in FIG. 2 in that the positive-pressure tank liquid level sensor 28 is omitted. Moreover, the positive-pressure tank 21 is disposed at a position above the inkjet head 11. However, the positive-pressure tank 21 of the ink circulation unit 12A may be disposed at the same height as the negative-pressure tank 24 as in the ink circulation unit 12 in FIG. 2.

The pressure adjuster 3A has a configuration different from that of the pressure adjuster 3 of the first embodiment showing FIG. 2 in that the positive-pressure adjuster 41 is replaced by a positive-pressure equalizer 72.

The positive-pressure equalizer 72 causes the pressures in the air spaces of the positive-pressure tanks 21 of the respective printing units 71 to be the same. The positive-pressure equalizer 72 has a configuration in which the air conduit 53 and the air pump 55 are omitted from the positive-pressure adjuster 41 in FIG. 2.

Upon starting printing, the controller 5 controls the negative-pressure adjuster 42 of the pressure adjuster 3A to apply a negative pressure force to the negative-pressure tank 24 of each printing unit 71. Moreover, the controller 5 feeds the ink from the negative-pressure tank 24 to the positive-pressure tank 21 by using the ink pump 25 in each printing unit 71 to apply a positive-pressure force to the positive-pressure tank 21 and the positive-pressure common air chamber 51. This generates a flow of ink from the positive-pressure tank 21 to the negative-pressure tank 24 via the inkjet head 11 and the ink circulation starts. During the ink circulation, the controller 5 controls the ink pump 25 such that the positive-pressure force applied to the positive-pressure tank 21 and the positive-pressure common air chamber 51 is maintained.

When the controller 5 drives the ink pumps 25 of the respective printing units 71 to apply and maintain the positive-pressure force to the positive-pressure tanks 21 of the respective printing units 71 and the positive-pressure common air chamber 51, the controller 5 drives the ink pumps 25 of the respective printing units 71 out of phase with each other.

Next, an operation of the inkjet printer 1A is described.

When the print job is inputted, the controller 5 closes the negative-pressure atmosphere release valve 66. Closing the negative-pressure atmosphere release valve 66 causes the negative-pressure common air chamber 61 and the negative-pressure tanks 24 of the respective printing units 71 to be hermetically sealed.

Next, the controller 5 applies a negative-pressure force of a reference value to the negative-pressure common air chamber 61 and the negative-pressure tanks 24 of the respective printing units 71 by driving the air pump 65 of the negative-pressure adjuster 42 as in the first embodiment.

Then, the controller 5 starts drive of the ink pumps 25 of the respective printing units 71 to apply the positive-pressure force to the positive-pressure tanks 21 of the respective printing units 71 and the positive-pressure common air chamber 51. The ink circulation is thereby started. In this case, the positive-pressure atmosphere release valve 56 is closed. In other words, the positive-pressure common air chamber 51 and the positive-pressure tanks 21 of the respective printing units 71 are hermetically sealed.

The controller 5 starts driving the ink pumps 25 of the respective printing units 71 out of phase with each other. Specifically, the controller 5 starts driving the ink pumps 25 in the respective printing units 71 with the timings of drive start being shifted from one another by T/4, where T is a drive cycle of the ink pumps 25.

Figure 10:
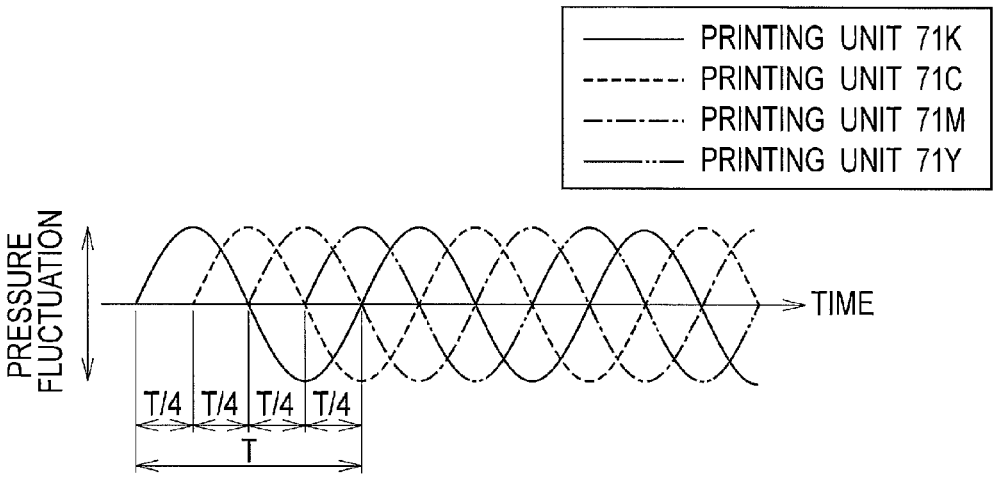
FIG. 10 is a view showing how pressures in positive-pressure tanks and a positive-pressure common air chamber fluctuate due to pulsation of ink pumps.

For example, the controller 5 starts driving the ink pumps 25 in the printing units 71K, 71C, 71M, and 71Y in this order with the timings of drive start being shifted from one another by T/4. In this case, as shown in FIG. 10, the waveforms of the pressure fluctuation in the positive-pressure tanks 21 and the positive-pressure common air chamber 51 due to pulsation of the ink pumps 25 are shifted from one another by T/4. Here, the pressure fluctuation due to the pulsation of the ink pump 25 in the printing unit 71K and the pressure fluctuation due to the pulsation of the ink pump 25 in the printing unit 71M which are shifted from each other by T/2 cancel each other out. Similarly, the pressure fluctuation due to the pulsation of the ink pump 25 in the printing unit 71C and the pressure fluctuation due to the pulsation of the ink pump 25 in the printing unit 71Y cancel each other out. The pressure fluctuation in the positive-pressure tanks 21 and the positive-pressure common air chamber 51 due to the pulsation of the ink pumps 25 is thereby suppressed.

The controller 5 drives each of the ink pumps 25 such that the flow rate of the ink from the ink conduit 26*c* to the positive-pressure tank 21 is faster than the flow rate of the ink from the positive-pressure tank 21 to the ink conduit 26*a*. This causes the liquid level in the positive-pressure tank 21 to rise and the air space of the positive-pressure tank 21 is pressurized.

When the detection value of the pressure sensor 57 of the positive-pressure adjuster 41 reaches a reference value of the positive-pressure force, the controller 5 changes the duty cycle of the ink pump drive signal.

Specifically, the controller 5 changes the duty cycle of the ink pump drive signal such that the flow rate of the ink from the positive-pressure tank 21 to the ink conduit 26*a* and the flow rate of the ink from the ink conduit 26*c* to the positive-pressure tank 21 becomes equal. The liquid level in the positive-pressure tank 21 of each printing unit 71 is thereby maintained, and the positive-pressure force in the positive-pressure tank 21 of each printing unit 71 and the positive-pressure common air chamber 51 is maintained at the reference value.

For example, the controller 5 drives the ink pumps 25 at a duty cycle of 100% until the detection value of the pressure sensor 57 reaches the reference value of the positive-pressure force, and drives the ink pumps 25 at a duty cycle of 50% after the detection value of the pressure sensor 57 reaches the reference value of the positive-pressure force.

Even after changing the duty cycle of the ink pump drive signal, the controller 5 drives the ink pumps 25 of the respective printing units 71 while maintaining the phase difference set at the drive start.

When the detection value of the pressure sensor 57 reaches the reference value of the positive-pressure force, the positive-pressure force of the positive-pressure tanks 21 and the negative-pressure force of the negative-pressure tanks 24 are at the reference values thereof. The nozzle pressure of each inkjet head 11 is thereby set within an appropriate range.

After the detection value of the pressure sensor 57 reaches the reference value of the positive-pressure force, the controller 5 performs printing by driving the inkjet heads 11 based on the print job.

In the printing operation (ink circulation), the controller 5 performs the ink supply to the negative-pressure tank 24 in each printing unit 71 when the negative-pressure tank liquid level sensor 29 switches to the off state. The operation in the ink supply to the negative-pressure tank 24 in the inkjet printer 1A is the same as the aforementioned operation in the ink supply in the inkjet printer 1 of the first embodiment.

When the print job is completed, the controller 5 stops the ink pumps 25. The ink circulation is thereby completed.

Next, the controller 5 opens the positive-pressure atmosphere release valve 56 and the negative-pressure atmosphere release valve 66. Opening the positive-pressure atmosphere release valve 56 causes the positive-pressure common air chamber 51 and the positive-pressure tanks 21 of the respective printing units 71 to be opened to the atmosphere. Moreover, opening the negative-pressure atmosphere release valve 66 causes the negative-pressure common air chamber 61 and the negative-pressure tanks 24 of the respective printing units 71 to be opened to the atmosphere. Thereafter, the controller 5 closes the positive-pressure atmosphere release valve 56. The inkjet printer 1A is thereby set to a standby state.

As described above, in the inkjet printer 1A, when the ink pumps 25 of the respective printing units 71 are driven during the ink circulation, the phases of the ink pumps 25 in the respective printing units 71 are shifted from one another. This can suppress an increase of pressure fluctuation in the positive-pressure tanks 21 of the respective printing units 71 and the positive-pressure common air chamber 51 which is caused by overlapping of the pulsation of the ink pumps 25 in the respective printing units 71. As a result, it is possible to reduce abnormal ejection of the ink due to fluctuation of the nozzle pressure of the inkjet head 11 in each printing unit 71 and alleviate a decrease of the printed image quality.

Other Embodiments

In the first and second embodiments, description is given of the inkjet printer having four printing units. However, the inkjet printer is not limited to this and may be any inkjet printer having multiple printing units.

The following control in the first embodiment may be omitted: the control for preventing coinciding of the times in which the inks flow into the negative-pressure tanks 24 in the respective printing units 2 in the ink supply; and the control for preventing coinciding of the times in which the inks flow into the positive-pressure tanks 21 in the respective printing units 2 in the feeding to the positive-pressure tanks 21. Also in this case, it is possible to reduce abrupt and large fluctuation of the nozzle pressure of the inkjet head 11 in each printing unit 2. As a result, it is possible to reduce abnormal ejection of the inks and alleviate a decrease of the printed image quality.

Among ink circulation type inkjet printers, there is one which has a negative-pressure adjuster 42 similar to those in the inkjet printers 1 and 1A in the first and second embodiment and which, for a positive-pressure side, applies a positive-pressure force to an inkjet head by using a hydraulic head difference between the inkjet head and a positive-pressure tank opened to the atmosphere. The control for preventing coinciding of the times in which the inks flow into the negative-pressure tanks in the respective printing units in the ink supply can be applied to such an inkjet printer as in the first and second embodiments.

In the first and second embodiments, the intermittent supply operation is performed in the ink supply. However, the ink supply operation is not limited to the intermittent supply operation and may be an operation in which the ink is continuously supplied by maintaining the open state of each ink supply valve 33 until the corresponding negative-pressure tank liquid level sensor 29 switches to the on state. There is no need to perform the intermittent supply operation, and it is only necessary to perform control such that the times in which the inks flow into the negative-pressure tanks 24 in the respective printing units do not coincide with one another.

In the first embodiment, the intermittent feeding operation is performed in the feeding to the positive-pressure tank. However, the feeding operation is not limited to the intermittent feeding operation and may be an operation in which the feeding is performed by continuously driving each ink pump 25 until the corresponding negative-pressure tank liquid level sensor 29 switches to the on state. There is no need to perform the intermittent feeding operation, and it is only necessary to perform control such that the times in which the inks flow into the positive-pressure tanks 21 in the respective printing units do not coincide with one another.

In the first and second embodiments, the environment temperature detected by the environment temperature sensor 4 is used as the information indicating the ink supply rate, and the continuous ink supply time Tv is set based on the environment temperature. However, the information indicating the ink supply rate is not limited to this. For example, it is possible to install a flow meter in the ink conduit 32 of the ink supply unit 13 and use an ink flow rate detected in advance by the flow meter as the information indicating the ink supply rate. Moreover, it is possible to provide a temperature sensor configured to detect the temperature of the ink inside the ink cartridge 31 and use the temperature of the ink detected by the temperature sensor as the information indicating the ink supply rate.

In the first embodiment, the temperature of the ink inside the ink circulation unit 12 which is detected by the ink temperature sensor 27 is used as the information indicating the flow-in rate of the ink in the feeding to the positive-pressure tank 21, and the continuous feeding time Tp is set based on this temperature. However, the information indicating the flow-in rate of the ink into the positive-pressure tank 21 is not limited to this. For example, it is possible to install a flow meter in the ink conduit 26*c* and use an ink flow rate detected in advance by the flow meter as the information indicating the flow-in rate of the ink into the positive-pressure tank 21. Moreover, it is possible to use the environment temperature detected by the environment temperature sensor 4 as the information indicating the flow-in rate of the ink into positive-pressure tank 21.

In the embodiments above, description is given of the printing units 2K, 2C, 2M, and 2Y and the printing units 71K, 71C, 71M, and 71Y configured to eject inks of different colors. However, the printing units are not limited to this and some or all of the printing units may eject inks of the same color. That is, inks circulated in the inkjet printer 1, 1A may include inks of the same color.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet printer comprising:

a plurality of printing units each comprising an inkjet head having nozzles for ejecting an ink therefrom, a first tank configured to store the ink to be supplied to the inkjet head, a second tank configured to receive the ink not consumed in the inkjet head, a circulation path configured to allow the ink to circulate among the first tank, the inkjet head, and the second tank, an ink pump configured to feed the ink from the second tank to the first tank, and an ink supply unit configured to supply the ink to the second tank;

a negative-pressure adjuster comprising a negative-pressure common air chamber in communication with the second tanks of the plurality of printing units, and a negative-pressure applying unit configured to apply a negative pressure force to the second tanks of the plurality of printing units and the negative-pressure common air chamber; and a controller configured to control the plurality of printing units and the negative-pressure adjuster, wherein, upon supply of the inks to the second tanks of the plurality of printing units with the second tanks in communication with each other via the negative-pressure common air chamber in an air-tight state and with the negative-pressure force applied to the second tanks and the negative-pressure common air chamber, the controller is configured to drive the ink supply units of the plurality of printing units to supply the inks such that times in which the inks flow into the second tanks in the plurality of printing units do not coincide with each other.

2. The inkjet printer according to claim 1, wherein the controller is configured to drive the ink supply units to perform an intermittent ink supply operation in the supply of the inks.

3. The inkjet printer according to claim 2, further comprising an ink supply rate information obtaining unit configured to obtain information indicating ink supply rates in ink supply operations of the ink supply units, wherein the controller is configured to determine a continuous ink supply time in the intermittent ink supply operation, based on the information obtained by the ink supply rate information obtaining unit.

4. The inkjet printer according to claim 1, further comprising a positive-pressure adjuster comprising a positive-pressure common air chamber in communication with the first tanks of the plurality of printing units and a positive-pressure applying unit configured to apply a positive-pressure force to the first tanks of the plurality of printing units and the positive-pressure common air chamber, wherein, upon feeding of the inks from the second tanks to the first tanks of the plurality of printing units with the first tanks in communication with each other via the positive-pressure common air chamber in an air-tight state and with the positive-pressure force applied to the first tanks and the positive-pressure common air chamber, the controller is configured to drive the ink pumps of the plurality of printing units to feed the inks such that times in which the inks flow into the first tanks in the plurality of printing units do not coincide with each other.

5. The inkjet printer according to claim 4, wherein the controller is configured to drive the ink pumps to perform an intermittent feeding operation in the feeding of the inks from the second tanks to the first tanks.

6. The inkjet printer according to claim 5, further comprising an ink flow-in rate information obtaining unit configured to obtain information indicating flow-in rates of the inks into the first tanks in the feeding of the inks from the second tanks to the first tanks, wherein the controller is configured to determine a continuous feeding time in the intermittent feeding operation, based on the information obtained by the ink flow-in rate information obtaining unit.

7. The inkjet printer according to claim 1, further comprising a positive-pressure common air chamber in communication with the first tanks of the plurality of printing units, wherein the controller is configured to in a printing operation, drive the ink pumps with the first tanks in communication with each other via the positive-pressure common air chamber in an air-tight state to feed the inks from the second tanks to the first tanks in the plurality of printing units, apply a positive-pressure force to the first tanks and the positive-pressure common air chamber, and maintain the positive-pressure force as applied, and drive the ink pumps of the plurality of printing units out of phase with each other.

8. An inkjet printer comprising:

a plurality of printing units each comprising an inkjet head having nozzles for ejecting an ink therefrom, a first tank configured to store the ink to be supplied to the inkjet head, a second tank configured to receive the ink not consumed in the inkjet head, a circulation path configured to allow the ink to circulate among the first tank, the inkjet head, and the second tank, an ink pump configured to feed the ink from the second tank to the first tank, and an ink supply unit configured to supply the ink to the second tank;

a positive-pressure adjuster comprising a positive-pressure common air chamber in communication with the first tanks of the plurality of printing units, and a positive-pressure applying unit configured to apply a positive-pressure force to the first tanks of the plurality of printing units and the positive-pressure common air chamber; and a controller configured to control the plurality of printing units and the positive-pressure adjuster, wherein, upon feeding of the inks from the second tanks to the first tanks of the plurality of printing units with the first tanks in communication with each other via the positive-pressure common air chamber in an air-tight state and with the positive-pressure force applied to the first tanks and the positive-pressure common air chamber, the controller is configured to drive the ink pumps of the plurality of printing units to feed the inks such that times in which the inks flow into the first tanks in the plurality of printing units do not coincide with each other.

* * * * *